United States Patent [19]

Gulliksen et al.

[11] 4,207,606

[45] Jun. 10, 1980

[54] LUMINAIRE APPARATUS AND IMPROVED MEANS FOR CONNECTING SAME WITH A POWER SOURCE

[75] Inventors: John E. Gulliksen, Shrewsbury; Roy A. Guimond, Holden; Mark S. Martino, Marlborough; Michael E. Collins, Northboro, all of Mass.

[73] Assignee: Koehler Manufacturing Company, Marlborough, Mass.

[21] Appl. No.: 885,396

[22] Filed: Mar. 10, 1978

[51] Int. Cl.[2] ..... F21L 15/14; H01R 13/58

[52] U.S. Cl. ..... 362/106; 339/103 B; 362/183

[58] Field of Search ..... 362/105, 106, 164, 165, 362/183; 339/103 R, 103 B, 103 C, 103 M, 104, 105, 106, 107

[56] References Cited

U.S. PATENT DOCUMENTS

| | | | |
|---|---|---|---|
| 1,757,887 | 5/1930 | Wheat | 362/106 |
| 2,066,811 | 1/1937 | Wheat | 362/183 |
| 2,131,617 | 9/1938 | Cowden | 362/106 |
| 2,281,654 | 5/1942 | Wulle | 339/103 B |
| 3,621,413 | 11/1971 | Hilbert | 339/103 B |
| 3,825,740 | 7/1974 | Friedman | 362/183 |

*Primary Examiner*—David H. Brown
*Assistant Examiner*—Donald P. Walsh
*Attorney, Agent, or Firm*—Spear, Hamilton & Brook

[57] ABSTRACT

A luminaire apparatus includes a luminaire housing body, an electrical cable member and a power source. Means are combined with the cable for compressibly securing one end of the cable in the housing in a position to provide an effective moisture seal and the cable jacket is held in fixed relation to the housing so that strain or pulling forces exerted on the cable are not transmitted to electrical conductors contained therein. When the power source is a battery of the class used in a miner's cap lamp apparatus, for example, in which the housing body is a headpiece to be attached to a miner's "hard hat", the electrical cable may have an opposite end sealably engaged in the battery top, and provided with a strain relief member. A portion of the cable extending inside the battery top is held in a cable locking device so that pulling forces exerted on the cable are not applied to electrical conductors connected to battery terminals. The battery top is provided with multiple charging contacts and unauthorized access to these contacts is prevented by electrical circuit means. Protection against maintained short circuits is provided by electrical circuit means capable of sensing heat changes. Optical and switching components normally occurring in a headpiece may also be built into a cap member such as a hard hat.

5 Claims, 15 Drawing Figures

LUMINAIRE APPARATUS AND IMPROVED MEANS FOR CONNECTING SAME WITH A POWER SOURCE

BACKGROUND OF THE INVENTION

In the luminaire art it is customary to provide a luminaire housing body in which lamp means may be supported and connected to a power source. A cable member is utilized to connect the lamp means with the power source and includes electrical conductor wires contained in an outer insulating jacket. In such equipment, there are many instances where the interior components of the luminaire body must be held sealed from contact with water and where the electrical components must be protected against strain and pulling forces exerted through the cable either at the point of entry of the cable in the housing body or at the point of connection with the power source.

This is especially true of luminaire apparatus of the cap lamp class wherein a headpiece is carried on a cap member such as, for example, a miner's cap or "hard hat". In such case, the power source is a battery which may be subject to periodic recharging. Moving a battery and its attached cable and headpiece into and out of charging apparatus can exert strain, excessive flexing and pulling forces of substantial intensity particularly where a miner may have a propensity for lifting the battery by means of the cable member. Difficulty may be experienced in sealing a headpiece against water because of the possibility that a vacuum will occur in the headpiece when it is turned off and is no longer subject to internal heating from the bulb.

Various proposals have been made to provide luminaire apparatus in which adequate water seals are realized. Other proposals have sought to combine sealing means with protection against strain and pulling forces exerted through a cable member.

For example, proposals of this nature are disclosed in U.S. Pat. Nos. 13,661,557; 1,757,888; 2,611,073; 2,907,871; 2,794,114; 2,947,853; 3,334,223.

In none of these patented devices has there been provided adequate sealing which can be practically combined with luminaire apparatus of the class referred to nor has there been disclosed any practical and efficient means of protecting electrical conductor elements from straining, flexing and pulling forces exerted through a cable jacket in which the conductor elements are contained.

SUMMARY OF THE INVENTION

This invention relates generally to luminaire apparatus and to electrical means for connecting the apparatus to a power source. The invention in one desirable form is particularly concerned with luminaire apparatus of the cap lamp class in which electrical cable means connects a headpiece to a battery and the battery is carried by a miner and is required to be recharged periodically.

It is a chief object of the invention to improve the utility, safety and operating life of luminaire apparatus and especially cap lamp apparatus and to devise means for more effectively sealing and protecting an electrical cable member at its point of entry in a housing body such as a headpiece. Another object of the invention is to provide improved means for sealably securing an electrical cable member at its point of attachment to a battery member and to provide cable sealing means with means for resisting pulling forces and insuring that such pulling forces are not transmitted to electrical conductor wires inside the cable.

A further object of the invention is to provide means for sealably connecting an electrical cable with a battery top and for resisting strain forces and undue flexing of the cable such as may be exerted when a battery member is lifted by means of the cable. Still another object is to devise improved means for recharging of a battery of the type employed in a miner's cap lamp apparatus.

These objectives are realized in part by constructing a luminaire body with a cable retaining portion having a tapered opening through which a cable member is received. A tapered bushing of larger diameter than the tapered opening is located around an end of the cable and lever hook means engageable with a housing body is operable to compressibly secure the bushing and cable in the opening in sealed relationship with the housing.

An opposite end of the cable is sealably connected into a battery by means of a strain relief member secured in a cable opening in the battery top and arranged to limit flexure of the cable. A portion of the cable inside the battery top is held in a cable locating device so that pulling forces exerted on the cable are not transmitted to electrical conductor wires secured to battery terminals. A plurality of charging contacts located in the battery top provide for more positive charging and unauthorized access to the contacts is prevented by electrical means. Optical and switching components usually present in a headpiece may be incorporated within the housing of a cap member.

DETAILED DESCRIPTION OF THE INVENTION

Figure 1:
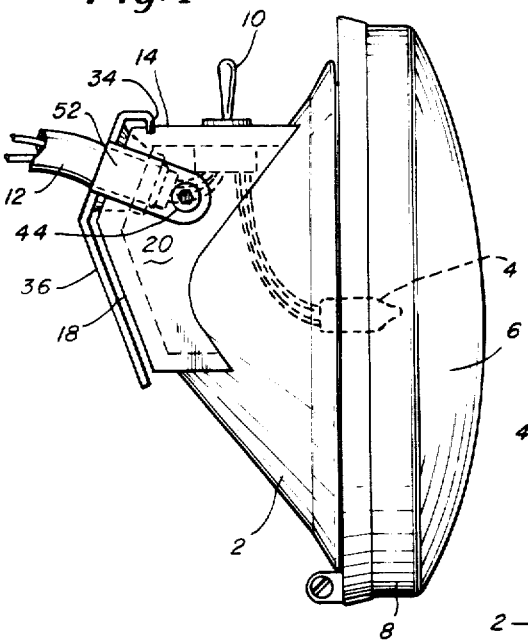
FIG. 1 is a side elevational view illustrating a luminaire housing body and means for sealably connecting the cable in the housing body.

Referring in more detail to the drawings, FIGS. 1-5 illustrate a luminaire apparatus in which an electrical cable is sealably secured by one desirable form of sealing means of the invention. As shown therein, numeral 2 denotes a housing body having a reflector chamber in which is mounted a lamp element 4 of conventional nature. Radiation from the lamp when energized is reflected through a radiation transmitting member 6 secured at one side of the housing by a bezel ring 8. Operation of the lamp is controlled by a switch 10.

It is intended that the luminaire housing body may be utilized by attaching it to a supporting means or it may be detached and manually held. It is also intended that this luminaire apparatus may be connected to a power source such as an AC wall outlet or other power source by an electrical member 12 indicated fragmentarily at the left side of FIG. 1.

Sealed engagement of the cable 12 in the housing 2 is, in accordance with the invention, carried out by means comprising a specially formed cable retaining portion formed in the housing 2, a resilient tapered bushing element, and means for compressing the tapered bushing and holding it in a compressed state in a tapered opening in the cable retaining portion.

Figure 2:
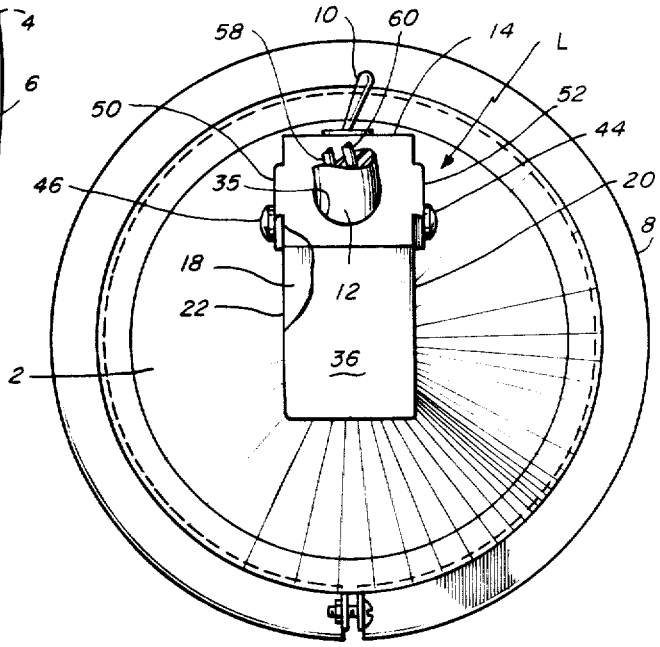
FIG. 2 is an end elevation of the luminaire housing of FIG. 1 further showing the electrical cable broken away.

Considering these parts in greater detail, numeral 14 denotes a cable retaining portion formed at the back of the luminaire body as an extension thereof (indicated in FIGS. 1 and 2). The retaining portion 14 extends rearwardly and downwardly to form an upper angled side 16 and a lower angled side 18 lying between parallel flat surfaces 20 and 22. The upper side 16 is recessed to form a tapered cable opening 24 which communicates with the housing interior 26 more clearly shown in FIG. 3.

Figure 4:
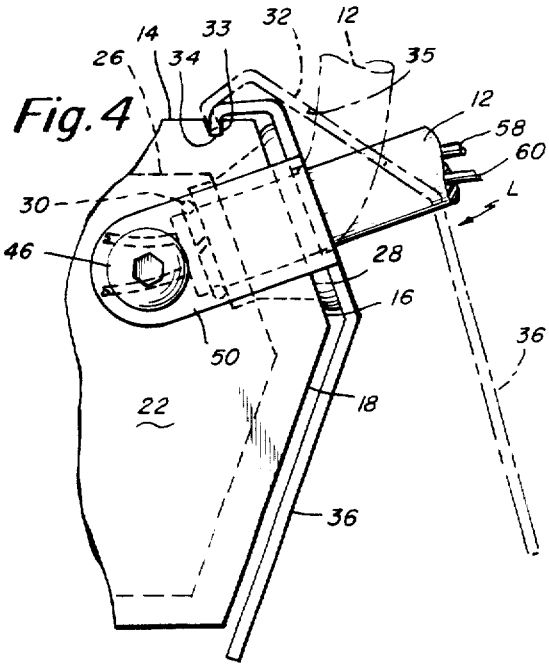
FIG. 4 is a fragmentary elevational view for illustrating on a larger scale the means for sealably connecting the electrical cable in the housing body.
Figure 5:
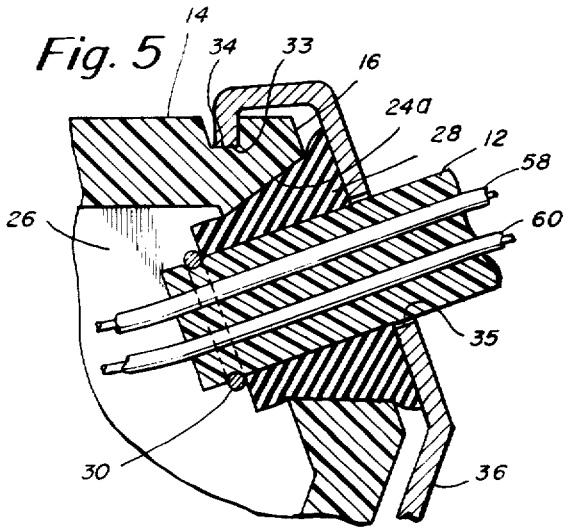
FIG. 5 is a detailed cross sectional view illustrating a portion of the cable and electrical conductor elements compressed in a tapered bushing.
Figure 6:
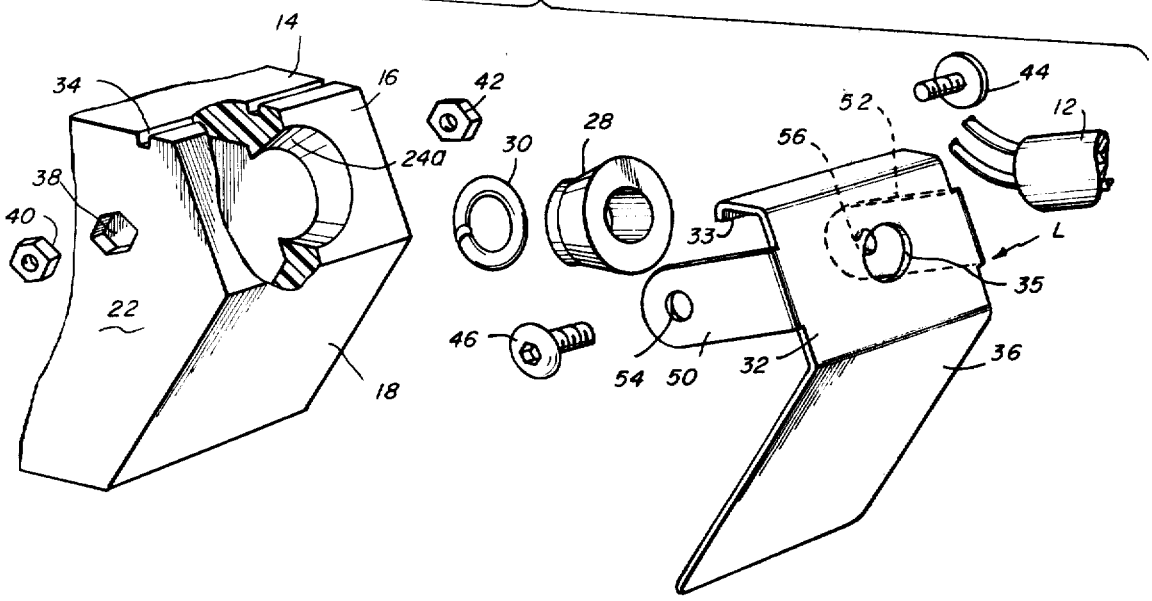
FIG. 6 is a exploded view illustrating a portion of the luminaire housing and showing sealing components removed from the housing and cable.

Numeral 28 denotes a resilient tapered bushing of rubber or other rubber-like material such as neoprene. This bushing member is indicated in FIGS. 4, 5 and 6 and is made of a tapered form similar in shape to the tapered opening 24 but of a cross sectional diameter greater than that of opening 24. The bushing is designed to fit snugly over an end of cable 12 at a desired point and is held in the tapered opening 24 in a compressed state.

At one side of the bushing 28, there is located around the cable 12 a clamping ring 30 which is tightly clinched against the outer surface of the cable in abutting relation with respect to an adjacent end of the bushing 28 as shown in FIG. 4. In FIG. 6, the clamping ring is shown removed from the cable.

Means above referred to for compressing the bushing and cable end into the cable opening includes a lever hook member generally indicated by the arrow L. An upper section 32 of the lever hook L is formed with a cable hole 35 through which the cable 12 is received as suggested in FIG. 4. A flange portion 33 formed at the upper end of the lever section 32 is engageable in a slot 34 at the top of the housing extension 14. The broken line showing in FIG. 4 indicates the lever hook in an untensed position.

A lower section 36 of lever hook L is angularly disposed with respect to the upper section 32 and serves two purposes. It provides a handle for moving the lever hook from the broken line position into the full line position of FIG. 4. In this full line position, it will be seen that the lower section 36 is held in spaced relation to the lowered angle side 18 of the housing extension 14 to constitute a clip portion by which the housing body may be attached to a bracket or similar means on which the luminaire apparatus may be desired to be located.

Figure 3:
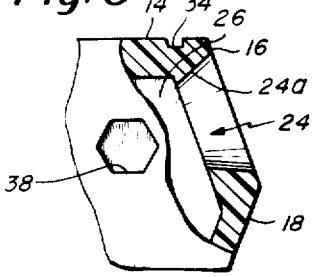
FIG. 3 is a fragmentary elevational view of a cable retaining portion of the housing partly indicated in cross section to show a tapered opening in which a cable end may be received.

Parallel surfaces 20 and 22 of the housing extension 14 are recessed to form cavities one of which is denoted by numeral 38 and shown in FIGS. 3 and 6. These cavities are appropriately shaped and dimensioned to receive captive nut members 40 and 42 which are pressed into their respective cavities therein. Screws 44 and 46 (FIG. 6) are provided for threaded engagement with respective nut members.

The sealing components are assembled in the following manner. Lever hook L is first slid over end of cable 12. Bushing 28 is then slid over the cable end. Split clamping ring 30 is thereafter located around the cable end and tightened on the cable in a desired position such as indicated in FIG. 4. The tapered bushing 28 is slid back along the cable until its small end is located in abutting relation to the clamp ring 30. The free end of the cable together with the clamping ring and bushing are entered in the cable opening 24 with the tapered outer surface of the bushing engaging with the surface 24a of the cable opening. Lever hook L is slid back along the cable until upper section 32 comes into contact with upper angled side 16 of the housing extension and the flange 33 is engaged in slot 34 in the housing 14 as shown in broken lines in FIG. 4.

Pressure is exerted on section 36 of the lever hook L with flange 33 turning in the slot 34 and the resulting lever action forces the cable and bushing 28 into the opening 24. As this occurs, the relatively larger bushing is compressed against the tapered surface 24a of the opening 24 and the lever section 36 moves into the position shown in FIGS. 4 and 5. Retaining lugs 50 and 52 slideably engage over surfaces 20 and 22 and lug openings 54 and 56 are brought into alignment with the captive nuts 40 and 42. Screws 44 and 46 are then inserted through respective lug openings and threaded into nuts 40 and 42 to solidly secure the lever hook in fixed relation to the housing extension and to hold the bushing in the compressed position described. It is pointed out that when thus compressed, the bushing 28 provides a water seal between itself and the surface 24a of the opening 24, and also at the area of engagement of the bushing with the outer jacket of cable 12. In FIG. 5, the bushing 28 is shown on a larger scale compressed around the jacket of the cable by the leverage exerted by the lever hook. It will be noted that frictional engagement of the bushing with the jacket insures that the cable 12 cannot be pushed farther into the housing and further insures that any strain or pulling forces exerted on the cable cannot be transmitted to the electrical conductor wires 58 and 60 inside the cable jacket as shown in FIG. 5.

It will be appreciated that when the cable and means disclosed for sealing an end of the cable in a housing is to be utilized with a power source such as a battery, it is highly desirable that the opposite end of the cable should also be sealably and protectively connected to the battery.

Figure 7:
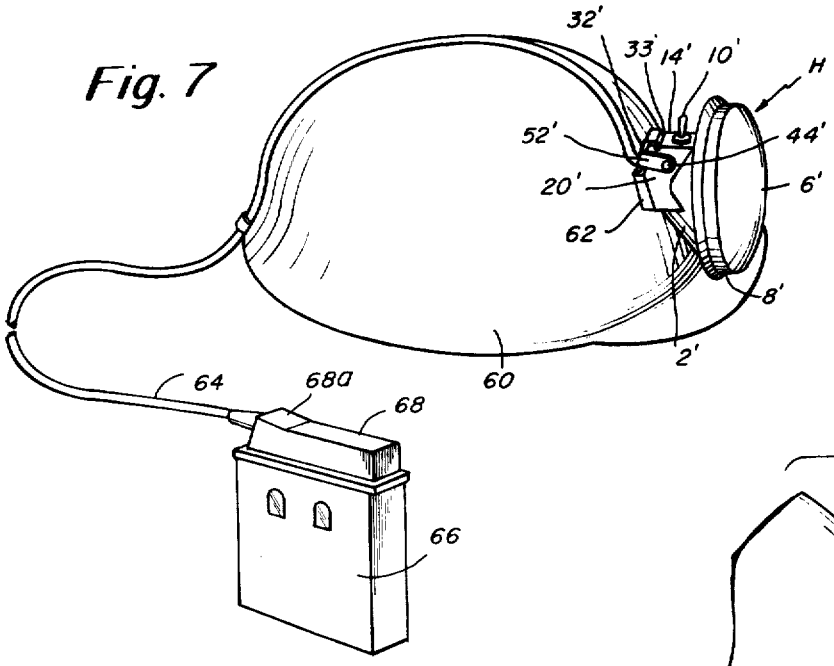
FIG. 7 is a diagrammatic view illustrating a luminaire housing in the form of headpiece attached to a cap member and having connected thereto a cable and battery means for energizing a lamp in the headpiece.
Figure 9:
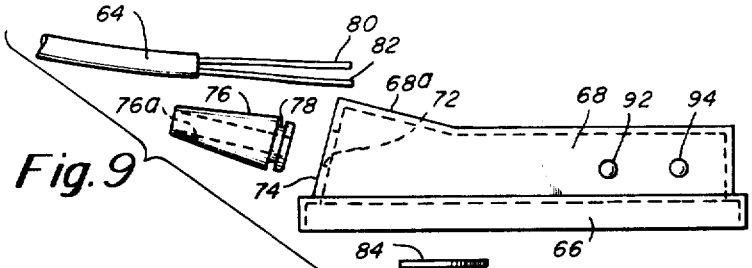
FIG. 9 is a diagrammatic view illustrating means for sealably connecting the electrical cable with a battery.
Figure 10:
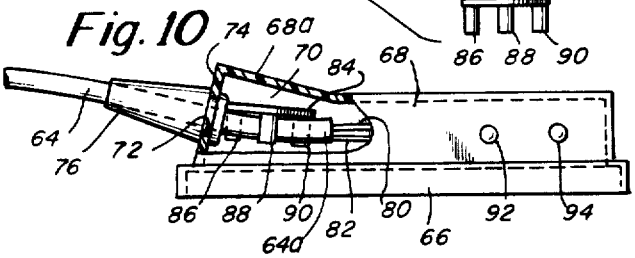
FIG. 10 is a view showing the cable sealably secured in the battery top.

FIG. 7 illustrates a battery-operated luminaire apparatus of the cap lamp type. This cap lamp apparatus may find application in various fields of use such as in mining and particularly underground mining where explosive gases may be present. As shown in FIG. 7, numeral 60 denotes a cap member of the "hard hat" type having a bracket 62 to which is attached a luminaire housing body commonly referred to as a headpiece and indicated by the arrow H. A cable member 64 connects a battery 66 to the headpiece H and the battery is particularly illustrative of a rechargeable battery such as is carried by miners on a belt member. The headpiece H is of a construction similar in all respects to the luminaire housing 2 disclosed in FIGS. 1–6 and component parts of the headpiece H are denoted by similar but primed reference characters. Cable sealing and protection objectives noted above are realized by providing a novel cable retaining top for the battery 66 and combining with the top a strain relief element and cable lock means. These parts are shown in more detail in FIGS. 9, 10 and 11 wherein numeral 68 indicates the battery top which is formed with a cable enclosure portion 68*a*. As shown in FIG. 9 and 10, the portion 68*a* extends upwardly from the battery 66 a short distance to define a small chamber 70 and communicating therewith is cable aperture 72 formed in an end wall 74 of the battery top.

Figure 11:
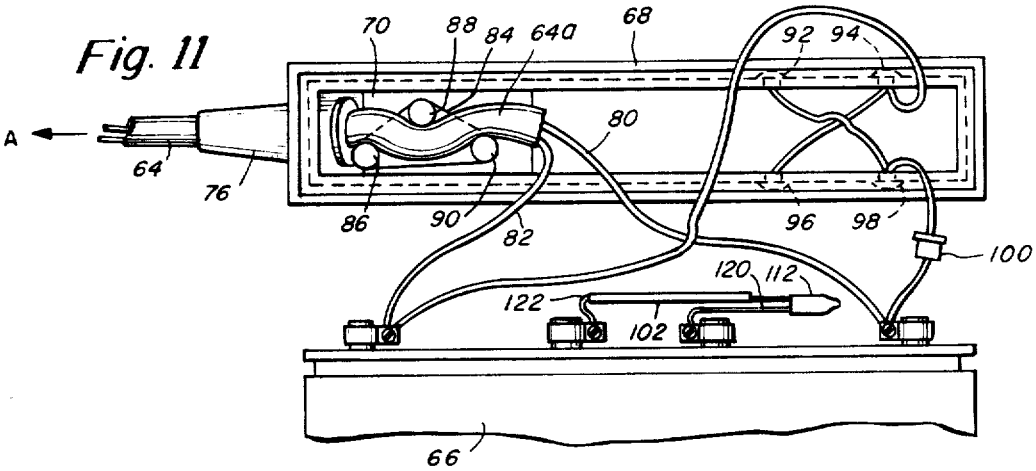
FIG. 11 is a fragmentary elevational view illustrating a portion of the battery with the cover removed and viewed from an underside thereof.

As indicated in FIGS. 10 and 11, an end portion 64*a* of the cable 64 is located in the chamber 70 and mounted around the cable in sealing relationship therewith is a tapered strain relief element 76. The strain relief element is formed with a groove 78 (FIG. 9) of a diameter greater than the diameter of the cable aperture 72 so that when compressed within the aperture 72 an effective water seal is realized.

It will be noted that the strain relief member 76 is of a tapered form and projects outwardly from the battery top in a position to prevent undue flexure of the electrical conductors 80 and 82 contained in cable 64. The size and shape of the projecting part insures that any flexure of the cable will have a relatively large radius of curvature. Frictional engagement of the inner surface 76*a* of the strain relief member 76 with the outer jacket of cable 64 prevents the cable from pushing farther into the battery top chamber. The end of cable 64 which extends into the chamber 70 is further secured by means of a cable lock member consisting of a base part 84 on which are located in staggered relation posts 86, 88 and 90. The cable end 64*a* is threaded between the posts so that they frictionally engage and hold opposite sides of the cable end in a reversely folded position.

In this position, the cable lock insures that any pulling forces exerted on the cable will be absorbed by the outer jacket of the cable and will not be transmitted to the electrical conductors 80 and 82. It will be noted that assembly is carried out in the following controlled manner. First, cable 64 is inserted through cable aperture 72 and drawn through the body 68. Strain relief member 76 is then threaded on over the end of cable 64. Cable end 64*a* (FIG. 10) is then threaded between the posts 86, 88 and 90 of the cable lock as is further shown in FIG. 11. At this time, there is exerted on cable 64, as indicated by arrow A, a force which causes the tapered end of strain relief member 76 to enter the cable aperture 72. Continued tension causes cable 64 to slide through the strain relief member 76 until the cable lock member 84 abuts the larger end of the member 76. Further increase in tension then forces member 76 through aperture 72 and the groove 78 becomes engaged in edges of opening 72 and thus places element 76 under compression to provide a sealing function.

In addition to the means disclosed for protectively connecting a cable with a luminaire body and/or a battery, the cap lamp apparatus of FIGS. 7–14 may also include improved means for connecting the battery with battery charging apparatus of the class utilized for example in charging miner's cap lamp batteries.

Figure 12:
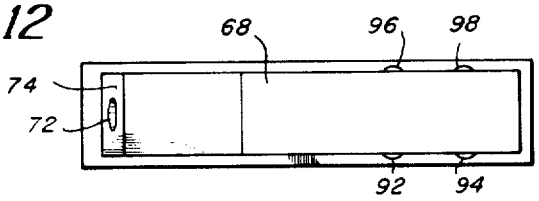
FIG. 12 is a view illustrating in more detail charging contact mounted in the battery.

As shown in FIGS. 11 and 12, the battery top 68 is provided at opposite outer sides thereof with battery charging contacts 92, 94, 96, 98 and these four contacts are intended to make contact with contact members contained within a battery charging apparatus. Diagonally opposed contacts 96 and 94 are connected together as shown in FIG. 11 and similarly contacts 92 and 98 are connected together. Battery top 68 should be fabricated of some electrically insulating material or contacts 92–98 are required to be electrically insulated from said battery top member.

The redundancy created by these contacts and the configuration of the electrical connections thereto is intended to improve the reliability of the charging arrangement. In the mining environment a great deal of foreign matter is present some of which, as in the case of cement used in some kinds of mine shaft sinking, may tend to coat the battery top and thus any charging contacts contained thereon. However, the battery is normally worn on a belt of a miner and one surface or the other of the battery top member 68 will be rubbed against the operator's body and thus protected from such deposits. There will also be a certain cleaning effect upon contacts contained on this surface from the action of the miner's clothing as the miner moves about.

The cross-section of the contacts insures that if any two adjacent contacts 96 98, 98 94, 94 92, or 92 96, make electrical contact with their counterparts in the charging mechanism, the battery will be charged. Obviously, these contacts, 92-98 inclusive, are not protected from unauthorized access by any mechanical means. They must therefore be protected electrically.

Figure 13:
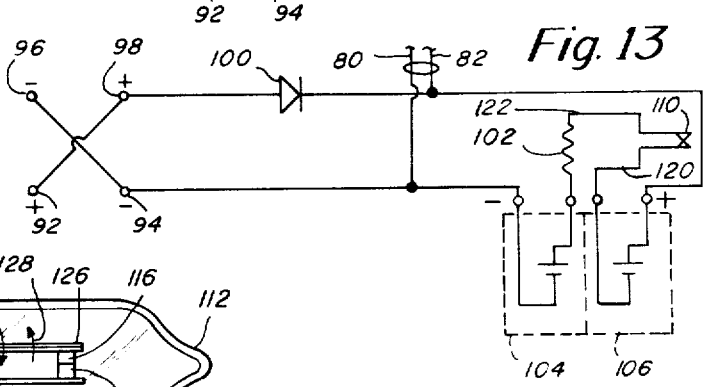
FIG. 13 is a schematic view illustrating wiring details of the charging contact assembly.

FIG. 13 illustrates an electrical schematic showing of an electrical circuit which can provide protection. One simple method of protecting contacts as shown in the circuit is by insertion of a blocking diode 100 in series with either the positive or negative contacts so that current may flow to the battery through the said contacts but no current may be drawn from the battery through said contacts.

In actual practice, a Schottky diode is employed because of its lower forward voltage drop and its uniformity from one diode to another. It will be appreciated that any diode may fail in a short-circuited mode. In order to provide for available energy from the battery being below the specified limits for intrinsic safety in a methane-air atmosphere, a resistance wire 102 in series with the battery is used. Since the battery disclosed is a preferred miner's embodiment consisting of a miner's battery having two cells 104, 106, said resistance wire 102 is employed also as a cell connector. This arrangement also insures that if the cable 64 is cut and its electrical conductors 80 and 82 are shorted to one another the current level available from the battery 66 will be less than that limit prescribed for intrinsic safety in a methane-air atmosphere.

Figure 14:
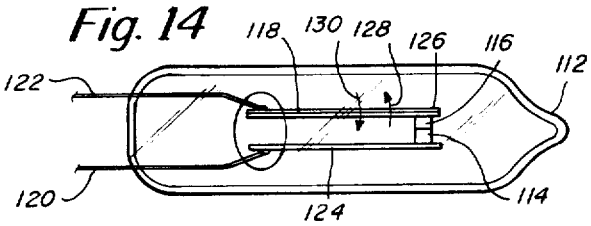
FIG. 14 is a diagrammatic view illustrating means for breaking the electrical circuit in the event of a maintained short circuit and for preventing unauthorized access to the terminals.

A maintained short circuit between conductors 80 and 82 or between contacts 96, 94 and 98, 92 in the event of a shorted diode, would result in an unreasonable heating of resistance wire 102. To safeguard against this occurrence, a small recycling thermal circuit breaker 110 is employed in series with resistance wire 102. A detailed schematic drawing of such an element is illustrated in FIG. 14. Enclosed within a glass envelope 112 are two contact members 114, 116. One of these contact members 114 is fixed in position, the other, 116, is attached to a bimetallic strip 118. Lead wires 120, 122 are attached to contact support member 124 and to bimetallic strip 118 respectively and are brought out of the glass envelope 112 for electrical connection.

Bimetallic strip 118 is so constructed as to react to an increase in temperature with a deflection of end 126 forcing contact 116 in the direction of the arrow 128. At normal temperature, contact members 114, 116 are pressed together in physical and electrical contact by spring tension of bimetallic strip 118 in the direction of the arrow 130. An undue amount of current flowing through the bimetallic strip 118 will cause a heat rise within it. Unequal expansion of the two metals in the strip will cause the afore-mentioned deflection in the direction of the arrow 128, thus breaking contact between 114 and 116 and opening the circuit.

When the circuit is opened, bimetallic strip 118 is allowed to cool whereupon contact is made between 114 and 116 and the cycle disclosed is repeated as long as the short circuit conditions are maintained. Resistance wire 102 is thus prevented from undue heating by the intermittent nature of current flow under short circuit conditions. It will be understood that such circuit breaker devices are of conventional nature. The arrangement described is tightly enclosed by securing the battery top 68 to the battery 66 by means of screws engaged in slots in the body of the battery. Recycling thermal circuit breaker 110 may at the designer's option be replaced by a fuse of suitably chosen rating.

Figure 8:
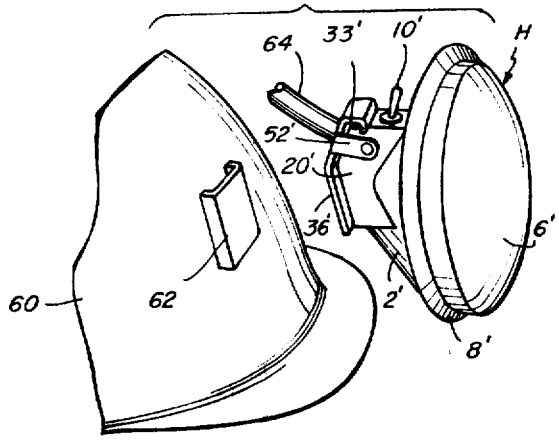
FIG. 8 is a view illustrating the cap member of FIG. 7 with the headpiece detached to further show bracket means in which the headpiece may be held.
Figure 15:
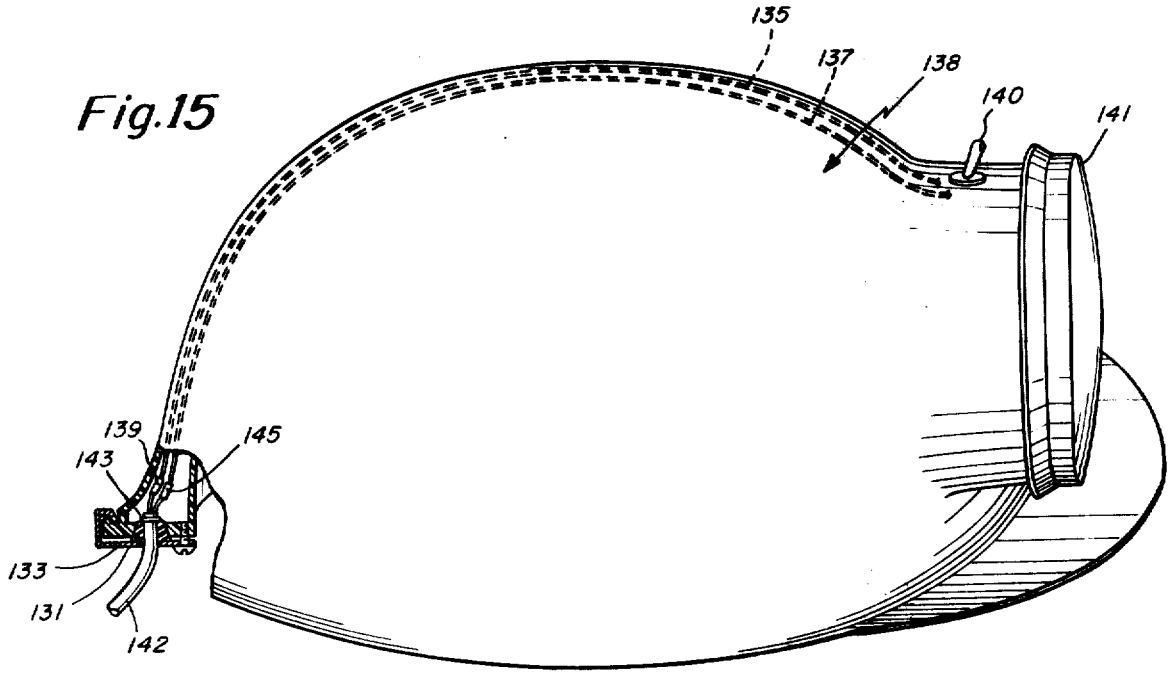
FIG. 15 is a diagrammatic view illustrating a cap member with a headpiece and internally located electrical conductor means.

In some instances, it may be desirable to incorporate optical and switching systems of the headpiece of FIGS. 7 and 8 directly in the protective headgear or "hard hat". This arrangement is illustrated in FIG. 15.

It will be noted that no cap bracket on cap 138 is required to hold the headpiece 141 and a switch 140 is located directly in back of headpiece 141. As shown at the rear portion of the headpiece 138, a cable 142 is led into the headpiece in a manner such as to effect a seal against moisture at the entry point. To effect such a seal, a small sealing plate 133 is secured in an opening formed in the headpiece by means of a screw as shown. The sealing plate is clamped around a bottom portion of the headpiece and the cable 142 is provided with a tapered sealing element 131 which is received through the sealing plate 133 and solidly secured by means of a clip member 143. Contact is made between the electrical extremities of the cable 142 and electrical conductors 139 and 145 molded integrally within headpiece 138 to conductor wires 135 and 137 which are located internally of the headpiece as shown.

We claim:

1. Luminaire apparatus of the cap lamp class including a cap member, a clip retaining bracket mounted externally of the cap member, a headpiece, lamp means mounted in the headpiece, a storage battery, electrical cable means arranged to electrically connect the battery with the lamp in the headpiece and energize same, said headpiece comprising a housing body having a reflector chamber which is located around the lamp means and which is closed at one side of the housing body by a radiation transmitting element, an opposite side of the housing body being formed with a housing extension, said housing extension presenting a horizontal top side having a slot located therethru, vertically disposed spaced apart parallel sides occurring substantially at right angles to the said top side and to opposite ends of the said slot, and a cable retaining portion extending from the said top side rearwardly and downwardly to provide upper and lower angular sides which intersect one another and which lie between the vertically disposed parallel sides, said upper angular side of the cable retaining portion being recessed to form a tapered cable opening through which the said electrical cable means is located, a resilient tapered bushing fitted around portions of the electrical cable means and engaging with the tapered cable opening, said bushing having a cross sectional diameter greater than that of the tapered cable opening and said bushing being further constructed with an axial length greater than that of the cable opening to provide an enlarged end which projects outwardly from the cable opening, a lever hook member engaged against the enlarged projecting end of the bushing, said lever hook member including a hooked edge, a depending angular lever part formed with a cable aperture through which the electrical means is received, and lug means formed integrally at opposite edges of the upper angular side part, said hooked edge being engaged in the said slot in the top side of the housing extension and said angular lever part being located in a position to exert compressive forces against the bushing, and said lug means being secured against the two vertical sides of the housing extension for maintaining the angular lever part in said position in which compressive forces are exerted.

2. The invention of claim 1 in which the enlarged outer end of the bushing is compressed and overlies the cable opening in sealed relationship therewith and portions of the bushing are frictionally engaged with the cable to prevent pulling forces exerted on the cable being transmitted to component electrical conductor wires in the cable.

3. The invention of claim 2 in which a lower section of the annular lever part is supported in spaced parallel relation to the said lower angular side of the housing extension to constitute a clip for engaging within the said bracket on the cap member and locating said lower angular side of the housing extension against an outer surface of the bracket.

4. The invention of claim 1 in which a clamping ring is tightly secured around a portion of the cable means and is located in abutting relation to an inner end of the said bushing to further resist pulling forces exerted on the cable means.

5. A cap lamp for use on a cap member of the class having a clip retaining bracket mounted externally thereof, said cap lamp comprising a headpiece housing body having a lamp member mounted therein and a reflector chamber located around the lamp member, said reflector chamber being closed at one side by a radiation transmitting element, an opposite side of the housing body being formed with a housing extension, said housing extension presenting a top side having a slot located therethrough, spaced apart sides and a cable retaining portion extending from the said top side rearwardly and downwardly to provide upper and lower angular sides, said upper angular side of the cable retaining portion being recessed to form a tapered cable opening through which electrical cable means is located, a resilient tapered bushing fitted around portions of the electrical cable means and engaging with the tapered cable opening, said bushing being constructed with an axial length greater than that of the cable opening to provide an enlarged end which projects outwardly from the cable opening, a lever hook member engaged against the enlarged projecting end of the bushing to exert compressive forces, said lever hook member including a hooked edge, a depending angular lever part formed with a cable aperture through which the electrical cable means is provided, and lug means formed integrally at opposite edges of the upper angular side, said hooked edge being engaged in the said slot in the top side of the housing extension and said lever part being located in a position to exert compressive forces against the bushing, said lug means being secured against the spaced apart sides of the housing extension for maintaining the angular lever part in said position in which compressive forces are exerted, said lever hook including means for engaging the cap lamp with a clip retaining bracket on a cap member.

* * * * *